United States Patent [19]

Stickler

[11] 4,115,892

[45] Sep. 26, 1978

[54] SCRAPING TOOL

[76] Inventor: Heinz Stickler, Bahnstrasse 258, A-2551 Enzesfeld, Austria

[21] Appl. No.: 810,751

[22] Filed: Jun. 28, 1977

[51] Int. Cl.[2] ..... A47L 13/08

[52] U.S. Cl. ..... 15/105; 15/236 R; 30/136.5; 30/169

[58] Field of Search ..... 15/105, 236 R; 30/136, 30/136.5, 169–172, 280, 321

[56] References Cited

U.S. PATENT DOCUMENTS

| | | | |
|---|---|---|---|
| 1,540,938 | 6/1925 | Gordon | 30/169 |
| 1,978,091 | 10/1934 | Kunderbagian | 30/171 |
| 2,106,055 | 1/1938 | Long | 30/169 |
| 2,333,878 | 11/1943 | Nelson | 30/172 X |

FOREIGN PATENT DOCUMENTS

| | | | |
|---|---|---|---|
| 337,436 | 6/1977 | Austria | 15/236 R |

*Primary Examiner*—Daniel Blum
*Attorney, Agent, or Firm*—Karl F. Ross

[57] ABSTRACT

A tool for scraping coatings such as paint or paper from walls and similar surfaces comprises a housing with a flat guide face designed to come to rest against a surface to be scraped, two lateral housing walls extending beyond a transverse edge of that guide face and carrying a blade swingably mounted thereon with the aid of a pair of shanks having pivot pins received in slots perpendicular to the guide face to enable an adjustment of the blade position. The blade is externally concave between two working edges which are parallel to the transverse edge of the guide face and come alternately into contact with the surface to be scraped, depending upon the direction of movement of the tool thereover. An ancillary attachment, to be used in the scraping of curved surfaces, can be clipped onto the transverse guide-face edge and additionally supported by the convex side of the swingable blade.

14 Claims, 7 Drawing Figures

SCRAPING TOOL

FIELD OF THE INVENTION

My present invention relates to a tool for the scraping of coatings, e.g. paint or paper, from walls, floors, ceilings and other flat or moderately curved surfaces.

BACKGROUND OF THE INVENTION

In my published Austrian patent specification No. 337,436 I have disclosed a tool of this character designed for alternate scraping in opposite directions. The tool comprises a double-edged blade pivotally mounted at an end of a box-shaped housing provided with a handle, this blade being swingable between two stops so as to let either one or the other blade edge come into contact with a surface along which the tool body is slid in one or the other direction. Between its two working edges the blade is curved about its swing axis, it convex side coming to rest against the surface to be scraped. Loose particles removed from that surface by the blade fall into the housing and are collected at its bottom.

OBJECTS OF THE INVENTION

An object of my present invention is to provide an improved and more versatile scraping tool of this character.

Another object is to provide a tool of this type which can be fitted with an attachment for the scraping of hollow surfaces that cannot be conveniently attacked by the swingable blade.

SUMMARY OF THE INVENTION

According to one aspect of my present invention, the swingable blade is pivoted to opposite sidewalls of the elongate tool body, at a location in front of a transverse boundary of a foreshortened wall of that body, and is outwardly concave about an axis of curvature parallel to its swing axis; the sidewall extensions carrying the blade are set back from a guide face formed by that foreshortened wall. This allows either of its working edges, which in respective limiting positions of the blade are located at substantially the level of the guide face while contacting the surface to be scraped, to bite into the coating of that surface at a steep angle close to 90° for more effective scraping. The limiting positions of this blade are determined by abutments which can be formed by edges of the tool body if the blade is part of a yoke including a pair of shanks bracketing the two sidewalls. Advantageously, these shanks have pivot pins received in slots of the sidewalls to facilitate an adjustment of the extent to which the surface layer to be scraped is penetrated by the working edges of the blade.

According to another aspect of my invention, an ancillary blade with a sharpened front edge can be clipped onto the foreshortened body wall upon being inserted into the yoke so as to be supported by the pivoted main blade when used for the scraping of hollow wall surfaces, for example.

BRIEF DESCRIPTION OF THE DRAWING

The above and other features of my invention will now be described in detail with reference to the accompanying drawing in which.

SPECIFIC DESCRIPTION

Figure 2:
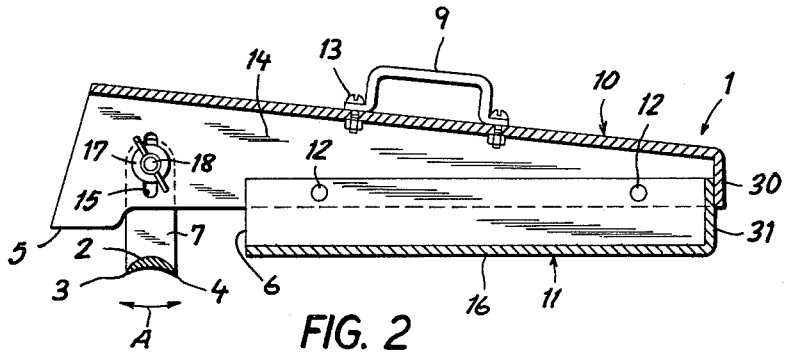
FIG. 2 is a cross-sectional view taken on the line II — II of FIG. 1.
Figure 1:
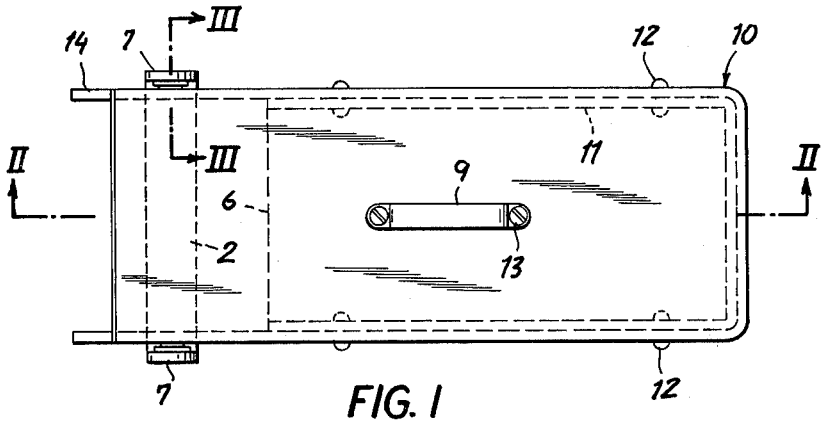
FIG. 1 is a face view of a scraping tool embodying my invention.

As indicated in FIGS. 1 and 2, a scraper according to my invention comprises an elongate housing 1 composed of two box-shaped shells or pans fitted together, i.e. a longer upper shell 10 and a shorter lower shell 11 as viewed in FIG. 2. Shell 10 carries a handle 9, secured to it by screws 13, and forms a pair of sidewalls 14 embracing the shell 11 between them. The two shells 10, 11 are riveted together at 12 and have back walls 30, 31 forming a closed bottom when the tool is held upright as in FIGS. 4 and 5.

Figure 4:
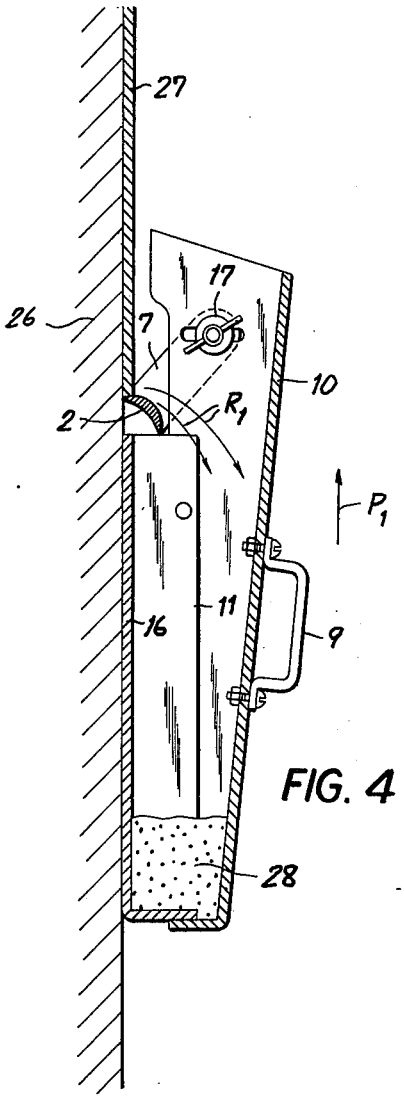
FIG. 4 is a cross-sectional view showing the tool moving upwardly along a wall surface to be scraped.
Figure 5:
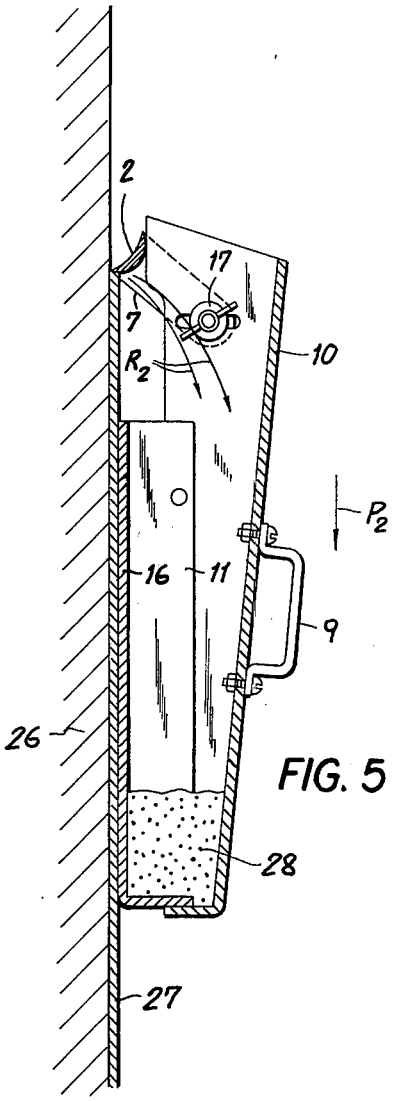
FIG. 5 is a view similar to FIG. 4, showing the tool moving downwardly along the wall surface.

A bottom wall 16 of shell 11, transverse to sidewalls 14, is foreshortened with reference to shell 10 and terminates in a U-shaped front edge 6; longitudinal edges 5 of these sidewalls, extending beyond transverse edge 6, are set back from a flat guide face formed by the foreshortened wall 16, this guide face coming into contact with a surface of a substrate such as a building wall 26 to be scraped as seen in FIGS. 4 and 5.

Figure 3:
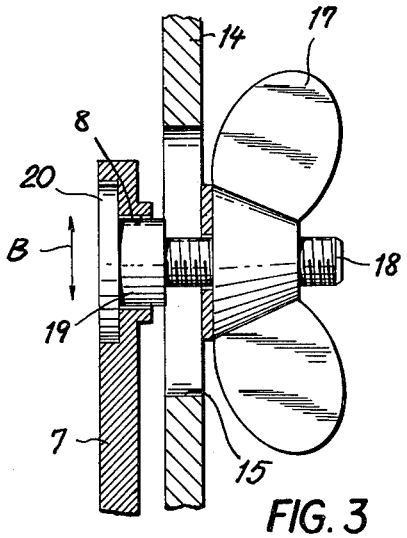
FIG. 3 is a sectional detail view drawn to a larger scale and taken on the line III — III of FIG. 1.

Within the recess formed by the angularly adjoining edges 5 and 6, a main blade 2 is swingably disposed as indicated by an arrow A in FIG. 2. Blade 2 is carried by a pair of lateral shanks 7 with which it forms a yoke pivoted to shell 10 by means of pins 18 that are received in slots 15 of sidewalls 14 perpendicular to edges 5. As more fully illustrated in FIG. 3, pivot pins 18 are bolts provided with heads 20 and necks 19 received in holes 8 of shanks 7, the necks 19 being wider than the slots 15 and long enough to let the shanks swing freely between sidewalls 14 and heads 20. Wing nuts 17, threaded onto bolts 18, define the swing axis of yoke 2, 7 and can be loosened to permit a shifting of that axis to the extent allowed by the length of the slots as indicated by an arrow B.

Blade 2 has a pair of working edges 3 and 4, parallel to its swing axis, which become alternately effective according to the direction of relative displacement of the tool and the surface to be scraped thereby. Thus, as seen in FIG. 4, the working edge 3 bites into a layer 27 to be removed when the tool housing 1 is displaced forwardly (i.e. upwardly in this instance as indicated by an arrow $P_1$), the resultant chips falling into the housing (arrows $R_1$) to accumulate in a pile 28. With the tool moving rearward as shown in FIG. 5 (i.e. downwardly as indicated by an arrow $P_2$), working edge 4 becomes similarly effective and also lets the detached fragments fall into the housing (arrows $R_2$). The steep angle of attack of these working edges, whose tangents in FIGS. 4 and 5 are almost perpendicular to the surface of wall 26, is due to the fact that blade 2 is convex toward its swing axis and therefore concave toward the outside, in contrast to the disclosure of my Austrian patent application referred to above.

In the position of FIG. 4, with edge 3 effective, the other working edge 4 rests against the transverse boundary 6 of shell 11 acting as an abutment for the blade 2. In the alternate position of FIG. 5, the inactive edge 3 comes to rest against the projecting longitudinal edges 5 of sidewalls 14 constituting a second abutment. It will be apparent that edges 5 could also serve as a stop for working edge 4 if bottom wall 16 of shell 11 were further foreshortened.

Figure 6:
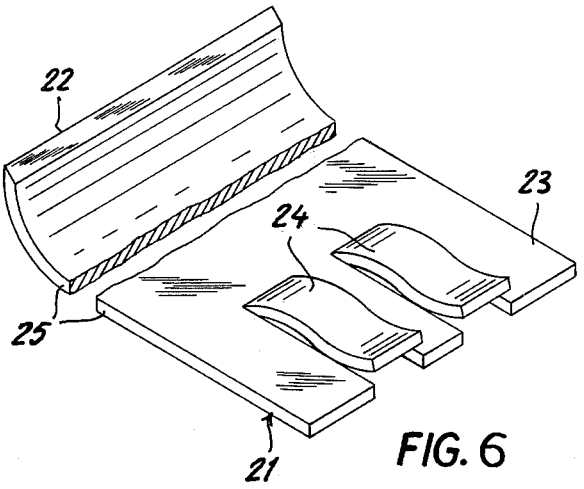
FIG. 6 is a perspective view of an ancillary scraping member attachable to the tool of FIGS. 1–5.
Figure 7:
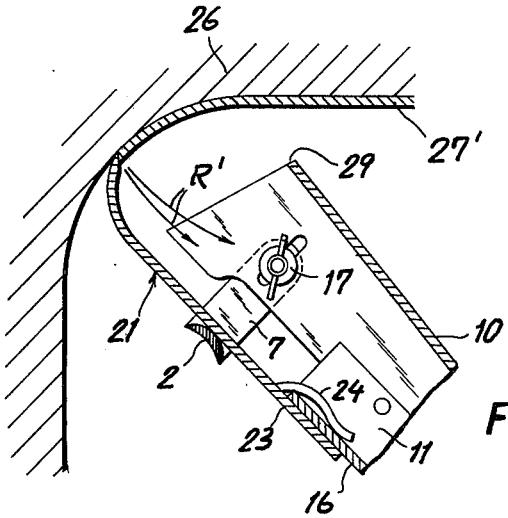
FIG. 7 is a fragmentary sectional view showing the tool fitted with the attachment of FIG. 6 while scraping a hollow wall surface.

An ancillary scraping member 21, shown in FIGS. 6 and 7, has a curved front portion 25 terminating in a sharpened edge 22 particularly designed for the removal of coatings from hollow surfaces. Attachment 21 is a blade substantially larger than blade 2 and is provided at its rear portion 23 with spring fingers 24 allowing it to be clipped onto wall 16 as seen in FIG. 7. Forward portion 25 of ancillary blade 21 passes through the yoke 2, 7 so as to be supported by the main blade 2 which is then in an intermediate, inoperative position. With blade 21 used to scrape a layer 27' from a curved upper edge of wall 26, the chips again fall into the interior of housing 1 as indicated by arrows R'.

Blade 21 could also be attached to a forward edge 29 of shell 10, yet in that case its scraping edge 22 would not be steadied by the main blade 2 as with the arrangement shown in FIG. 7. The adjustability of the swing axis of blade 2 on tool body 1, aside from facilitating an adjustment of the depth of penetration of edges 3 and 4 according to the thickness of a layer to be removed, allows the somewhat resilient blade 21 to be firmly held in contact with blade 2 when the latter is not being used for scraping.

As will be apparent from FIGS. 4 and 5, the bottom wall 16 rests during forward motion on a surface already stripped of its coating but slides on an as yet unremoved portion of that coating during reverse displacement. In the first instance, therefore, working edge 3 must lie substantially in the plane of the guide face of wall 16 whereas working edge 4 must protrude slightly beyond that plane in the second instance. The difference in the two edge positions, if significant, may be taken into account by a suitable curving of blade 2 or, as illustrated, by a slight raising of edges 5 at their point of engagement with edge 3.

I claim:

1. A scraping tool comprising:

an elongate body with a pair of sidewalls and a foreshortened wall perpendicular thereto, said foreshortened wall forming a flat guide face slidable along a surface to be scraped, said sidewalls having extensions set back from said guide face and projecting beyond a transverse boundary of said foreshortened wall to form a clearance between said body and the surface contacted by said guide face;

a blade in said clearance pivotally secured to said extensions with freedom to turn about a transverse swing axis parallel to said boundary, said blade having a pair of working edges parallel to said swing axis positioned for alternate engagement with the contacted surface upon sliding of said body thereover in opposite directions, said blade being outwardly concave about an axis of curvature parallel to said swing axis;

abutment means on said body for arresting said blade in two limiting positions in which said working edges are respectively located at substantially the level of said guide face; and an ancillary scraping member with a sharpened front edge and clip means remote from said front edge, said member being insertable into said clearance with said clip means engaging said foreshortened wall and with a portion of said member coming to rest on a convex reverse side of said blade.

2. A scraping tool as defined in claim 1 wherein said blade is provided with a pair of shanks bracketing said sidewalls, said shanks being pivoted to said extensions.

3. A scraping tool as defined in claim 2 wherein said extensions are provided with slots generally perpendicular to said guide face, said shanks being engaged by pivot pins adjustably received in said slots.

4. A scraping tool as defined in claim 2 wherein said sidewalls have longitudinal edges substantially parallel to said guide face, said longitudinal edges forming part of said abutment means.

5. A scraping tool as defined in claim 1 wherein said body is a housing with a closed bottom substantially perpendicular to said sidewalls and to said foreshortened wall for collecting material scraped off the contacted surface.

6. A scraping tool as defined in claim 5 wherein said housing comprises two box-shaped shells fitted together, one of said shells including said sidewalls, the other of said shells including said foreshortened wall.

7. A scraping tool as defined in claim 1 wherein said member is a plate with a curved extremity terminating in said front edge.

8. A scraping tool comprising:

an elongate body with a pair of sidewalls and a foreshortened wall perpendicular thereto, said foreshortened wall forming a flat guide face slidable along a surface to be scraped, said sidewalls having extensions set back from said guide face and projecting beyond a transverse boundary of said foreshortened wall to form a clearance between said body and the surface contacted by said guide face, said extensions being provided with slots generally perpendicular to said guide face;

a blade in said clearance having a pair of shanks which bracket said sidewalls and are pivotally secured to said extensions, by pivot pins adjustably received in said slots, with freedom to turn about a transverse swing axis parallel to said boundary, said blade having a pair of working edges parallel to said swing axis positioned for alternate engagement with the contacted surface upon sliding of said body thereover in opposite directions, said blade being outwardly concave about an axis of curvature parallel to said swing axis; and abutment means on said body for arresting said blade in two limiting positions in which said working edges are respectively located at substantially the level of said guide face.

9. A scraping tool comprising:

an elongate body with a pair of sidewalls and a foreshortened wall perpendicular thereto, said foreshortened wall forming a flat guide face slidable along a surface to be scraped, said sidewalls having extensions set back from said guide face and projecting beyond a transverse boundary of said foreshortened wall to form a clearance between said body and the surface contacted by said guide face, said sidewalls further having longitudinal edges which are substantially parallel to said guide face;

a blade in said clearance having a pair of shanks which bracket said sidewalls and are pivotally secured to said extensions with freedom to turn about a transverse swing axis parallel to said boundary, said blade having a pair of working edges parallel to said swing axis positioned for alternate engagement with the contacted surface upon sliding of said body thereover in opposite directions, said blade being outwardly concave about an axis of curvature parallel to said swing axis; and abutment means including said longitudinal edges on said body for arresting said blade in two limiting positions in which said working edges are respectively located at substantially the level of said guide face.

10. A scraping tool comprising:

an elongate housing composed of two box-shaped shells fitted together, one of said shells forming a pair of sidewalls, the other of said shells forming a foreshortened wall perpendicular to said sidewalls, said foreshortened wall forming a flat guide face slidable along a surface to be scraped, said sidewalls having extensions set back from said guide face and projecting beyond a transverse boundary of said foreshortened wall to form a clearance between said housing and the surface contacted by said guide face, said housing further having a closed bottom substantially perpendicular to said sidewalls and to said foreshortened wall for collecting material scraped off the contacted surface;

a blade in said clearance pivotally secured to said extensions with freedom to turn about a transverse swing axis parallel to said boundary, said blade having a pair of working edges parallel to said swing axis positioned for alternate engagement with the contacted surface upon sliding of said housing thereover in opposite directions, said blade being outwardly concave about an axis of curvature parallel to said swing axis; and abutment means on said body for arresting said blade in two limiting positions in which said working edges are respectively located at substantially the level of said guide face.

11. A scraping tool as defined in claim 10, further comprising an ancillary scraping member with a sharpened front edge and clip means remote from said front edge, said member being insertable into said clearance with said clip means engaging said foreshortened wall and with a portion of said member coming to rest on a convex reverse side of said blade.

12. A scraping tool comprising:

a generally prismatic housing with a foreshortened wall forming a flat guide face slidable along a surface to be scraped;

a yoke pivotally secured to said housing forwardly of a boundary of said wall with freedom to turn about a transverse swing axis, said yoke forming a main blade having a pair of working edges parallel to said swing axis positioned for alternate engagement with the contacted surface upon sliding of said housing thereover in opposite directions;

abutment means on said body for arresting said main blade in two limiting positions in which said working edges are respectively located at substantially the level of said guide face; and an ancillary blade with a sharpened front edge and clip means remote from said front edge, said ancillary blade being insertable into said yoke for coming to rest against said main blade in an intermediate position of the latter upon engagement of said clip means with said wall.

13. A scraping tool as defined in claim 12 wherein said yoke is adjustably pivoted to said housing for enabling a variation of its swing range.

14. A scraping tool as defined in claim 12 wherein said ancillary blade has a curved extremity terminating in said front edge.

* * * * *